US007069994B2

(12) United States Patent
Cooke, Jr.

(10) Patent No.: US 7,069,994 B2
(45) Date of Patent: Jul. 4, 2006

(54) METHOD FOR HYDRAULIC FRACTURING WITH SQUEEZE PRESSURE

(76) Inventor: Claude E. Cooke, Jr., 197 Lake View Cir., Montgomery, TX (US) 77356

( * ) Notice: Subject to any disclaimer, the term of this patent is extended or adjusted under 35 U.S.C. 154(b) by 56 days.

(21) Appl. No.: 10/801,461

(22) Filed: Mar. 16, 2004

(65) Prior Publication Data

US 2004/0231849 A1 Nov. 25, 2004

Related U.S. Application Data

(60) Provisional application No. 60/455,635, filed on Mar. 18, 2003.

(51) Int. Cl.
*E21B 43/267* (2006.01)

(52) U.S. Cl. ..... 166/308.5; 166/278; 166/280.1; 166/284

(58) Field of Classification Search ..... None
See application file for complete search history.

(56) References Cited

U.S. PATENT DOCUMENTS

| | | | | |
|---|---|---|---|---|
| 4,021,355 | A * | 5/1977 | Holtmyer et al. | 507/211 |
| 4,033,415 | A * | 7/1977 | Holtmyer et al. | 166/308.5 |
| 4,916,946 | A * | 4/1990 | Cameron | 73/152.18 |
| 5,411,091 | A * | 5/1995 | Jennings, Jr. | 166/280.1 |
| 5,566,759 | A * | 10/1996 | Tjon-Joe-Pin et al. | 166/300 |
| 5,813,463 | A * | 9/1998 | Stadulis | 166/280.1 |
| 5,890,536 | A * | 4/1999 | Nierode et al. | 166/284 |
| 6,342,467 | B1 * | 1/2002 | Chang et al. | 507/110 |
| 6,949,491 | B1 * | 9/2005 | Cooke, Jr. | 507/219 |

* cited by examiner

*Primary Examiner*—Zakiya W. Bates
(74) *Attorney, Agent, or Firm*—Claude E. Cooke, Jr.

(57) ABSTRACT

Method for hydraulic fracturing of wells by transporting a cross-linked polymer containing a proppant down a wellbore in a carrier fluid, allowing the cross-linked polymer to coalesce into a polymer phase and squeezing the cross-linked polymer as a fracturing fluid is provided. Composition of the cross-linked polymer solution and the selection of additives may be varied to adjust the viscosity, degradation time and other properties of the fracturing fluid.

23 Claims, 4 Drawing Sheets

METHOD FOR HYDRAULIC FRACTURING WITH SQUEEZE PRESSURE

This application claims the benefit of U.S. Provisional Application No. 60/455,635, filed Mar. 18, 2003.

BACKGROUND OF THE INVENTION

1. Field of the Invention

This invention pertains to treating wells to increase production rate by hydraulic fracturing. More particularly, methods are provided for increasing flow rate of wells by injecting a viscous fracturing fluid, which may be a cross-linked polymer solution, which may contain proppant particles, into an earth formation by pressuring a lower density fluid above the fracturing fluid to squeeze the fracturing fluid into the formation. In other embodiments, methods are provided for improving conventional hydraulic fracturing and sand control processes.

2. Discussion of Related Art

Hydraulic fracturing of earth formations around a well for increasing fluid productivity or injectivity of the well is a mature technology. Normally, thousands of gallons of an oil-based or water-based fluid, usually made viscous by addition of a soluble polymer, are injected into a formation at an injection rate such that the pressure of the fluid at the formation is higher than the earth stress in the formation. This causes a crack or fracture to develop in the face of the rock at the wellbore. Continued fluid injection into the well then causes the fracture to increase in length and width. After a sufficient width is achieved by continued fluid injection, particles, called "proppant," are added to the fluid. The fluid injected up until the time proppant is added is called "pad" fluid. After fluid injection has ceased, fracturing fluid flows out of the fracture, allowing the walls of the fracture to close on the proppant. The proppant particles then "prop" the walls of the fracture apart. Since proppant particles are normally much larger than the particles of the formation, the fluid permeability of the propped fracture is much greater than that of the formation; hence, the flow capacity of the well is increased. Fractures are often propped out to distances from about 200 feet to thousands of feet in each of two opposite directions from the wellbore in low permeability formations. Fractures as short as 25 feet may be formed in high permeability formations using convention gelled fluids and as short as 5 feet in high permeability formations using water as a fracturing fluid ("Water-Fracturing vs. Frac-Packing: Well Performance Comparison and Completion Type Selection Criteria," SPE 38593, Society of Petroleum Engineers, 1997). The flow rate into a well in a low-permeability formation can be increased several-fold by the hydraulic fracture, depending on the properties of the formation, the proppant and the geometry of the propped fracture. Along with the thousands of gallons of fracturing fluid, thousands of pounds of proppant are normally injected in a fracturing treatment in a low permeability formation, although it has been reported that in some wells injection of fluid alone (i.e., without proppant) at fracturing pressures has increased production rate. At the end of a fracturing treatment, proppant-laden fluid is "flushed" from the wellbore into the formation by a proppant-free displacement fluid, which is usually brine.

In more recent years, application of hydraulic fracturing along with gravel packing of wells has become very common, in a process often called "frac-packing." The formations in which this process is usually applied have high permeability, and the fracture is formed only to bypass permeability damage near a wellbore (SPE 38593, referenced above). It was recognized that a short fracture, in the range of 2 to 8 feet in length, could bypass damage in Gulf of Mexico wells that require sand control (SPE 38593, p. 286). Some evidence exists that conventional fracturing fluids, containing a soluble gelling polymer, damaged the permeability of the longer fractures formed with conventional fluids when gravel packing, whereas much shorter fractures formed with water appeared to be just as effective.

For hydraulic fractures formed by conventional processes to be effective, the fracture must be propped all the way to the wellbore. Even a short distance of unpropped fracture or of proppant with damaged permeability can greatly diminish or even eliminate the benefits of the long propped fracture. Therefore, there is need for materials and method to connect long propped hydraulic fractures in wells that have already been fractured all the way to the wellbore and eliminate any lack of proppant or damage to the propped fracture within a relatively short distance from a wellbore.

There is also a need for a method to prevent "overflushing" of proppant away from the wellbore by the displacement fluid at the end of a conventional fracturing treatment. Overflushing can be responsible for the lack of proppant in the fracture very near the wellbore.

In some hydraulic fracturing treatments, "flowback" of proppant is observed when the well is produced. This is a need for method to prevent this flow of proppant out of the fracture and into the wellbore after a fracturing treatment.

One of the benefits from hydraulic fracturing of many wells is removal of "damage" to flow capacity near a well. Damage removal in connection with gravel packing of very high permeability formations was discussed above, but damage to flow capacity of wells in all permeability ranges is widely observed. The mechanisms causing damage have been studied extensively, and include: clay blockage from drilling fluids, damage to rock permeability from shooting perforations into the formation, perforation plugging or formation damage from leakoff of completion fluids, migration of fine particles from the formation to the near-well region, and deposition of chemical scales from produced or injected water, or combinations of these phenomena. The distance to which damage extends from a wellbore is not known in each well, but it is generally believed to be not more than a few feet. Well stimulation methods that are generally used for damage removal near a wellbore include limestone and sandstone acidizing and solvent injection, but often these treatments are not successful or their effectiveness quickly diminishes as fluid is produced from a well. A hydraulic fracturing method and materials are needed to form a propped fracture having a high fluid flow capacity and extending only through the damage zone near a wellbore, or a relatively short distance from a wellbore, without the requirements of pumping large amounts of fluid and proppant into the well. The method should be applicable to a wide range of permeabilities of the formation around the well. This method can be especially needed in remote areas, where mobilizing of materials and equipment is expensive. The method is also needed to remove damage before gravel packing a well.

Theoretical models to predict the geometry of hydraulic fractures formed around wells have been developed. The models generally indicate that the width of a fracture at the wellbore increases with effective viscosity of the injected fluid in the fracture, rate of fluid injection and volume of fluid injected. To achieve a fracture width that can accept proppant without using large quantities of fluid, effective viscosity of the fracturing fluid must be high. But, viscosity of a fracturing fluid is normally limited by pressure loss as the fluid is pumped down a wellbore. Presently-used fracturing fluids minimize this pressure loss by employing polymer solutions that are highly non-Newtonian (shear-thinning). Otherwise, pressure loss due to friction in the tubing would allow injection only at very small rates. Water-soluble polymers are cross-linked to increase viscosity, and this cross-linking is sometimes delayed to decrease pressure loss in tubulars. Another limit on increasing viscosity of present fracturing fluids is that the water-soluble polymers most commonly used do not completely degrade, but leave a residue that adversely affects flow capacity of the proppant left in a fracture. Higher polymer concentrations in the injected fluid to produce higher viscosity and wider fractures would cause even greater damage to proppant flow capacity in the fracture in a conventional process. Other viscous solutions, based on surfactant molecules, have been developed, but they have disadvantages in the conventional fracturing process such as the uncertainty of positive reduction of viscosity with time and high cost. All presently used fracturing fluids and processes have the disadvantage that large quantities of liquid must be pumped into a well because the effective viscosity of the fluid in a fracture is limited.

A process using high effective viscosity fracturing fluid for damage removal must provide a method for controlling pressure loss in tubulars when the fluid is injected into a well. A process that allowed pumping high-viscosity oil at a high rate with low friction loss in tubulars by using a "water ring" was developed (the "Superfrac process", "A New Hydraulic Fracturing Process," *J. Pet. Tech.*, January 1970, 89–96). Difficulties in handling the oil and in controlling the process caused the process to lose favor, but the concept of using a lubricating layer in tubing to inject a viscous fracturing fluid was demonstrated. Large quantities of fracturing fluid were employed in this process, also. Since a water ring was used, the viscous oil was not the external phase in the tubing; this made possible low friction loss in tubing. If water was the external phase in a hydraulic fracture, viscous oil did not have high effective viscosity in the fracture, either. The effective viscosity of a viscous oil fracturing fluid flowing in the fracture would have been much lower than the viscosity of the oil, although the high viscosity of the oil was effective for proppant transport. The effective viscosity for flow in a fracture when using the "Superfrac" process is not known.

If a fracturing fluid has very high viscosity during formation of a hydraulic fracture, the fluid must degrade such that flow can be established through the fracture after the treatment. Very high viscosity fluids can create a hydraulic fracture and, if desired, carry proppant into the fracture using smaller amounts of fracturing fluid than used in conventional hydraulic fracturing processes, where pressure losses as fracturing fluid flows down a wellbore are a severe limitation on fluid viscosity that can be used. What is needed is a method for placing the very high viscosity fracturing fluid in a wellbore near the zone to be fractured without excessive pressure loss in the wellbore and then a method for forcing the very high viscosity fluid into the formation to form a hydraulic fracture with less fluid and pumping horsepower requirements than required with present methods.

SUMMARY OF THE INVENTION

Hydraulic fracturing processes employing a cross-linked polymer solution are disclosed. In one embodiment, the polymer solution may be placed in a wellbore near a formation to be fractured as a dispersed or discontinuous phase in a carrier fluid, so as to control pressure losses in the wellbore during placement. The polymer solution is then coalesced to a continuous or external phase in the wellbore and used as the fracturing fluid to form a fracture near a wellbore, such that the fluid has high effective viscosity in the fracture. The polymer solution is injected into the formation by application of pressure to a lower density fluid in the wellbore above the polymer solution, so as to squeeze the polymer solution or degradable polymer into the formation. In most applications, at least some of the polymer solution injected preferably carries a proppant into the fracture. Injection of a highly viscous cross-linked polymer solution can be used in a variety of well applications, including: forming a short fracture having length sufficient to bypass damage to permeability near a wellbore; placing proppant near a wellbore in a previously formed fracture; replacing damaged proppant near a wellbore in a previously formed fracture; preventing overflushing of proppant after a fracturing treatment; preventing flowback of proppant after a fracturing treatment; and forming a fracture, that may remain plugged for a selected time, before gravel packing or performing other completion or workover operations are performed in a well.

DETAILED DESCRIPTION OF THE INVENTION

Figure 1:
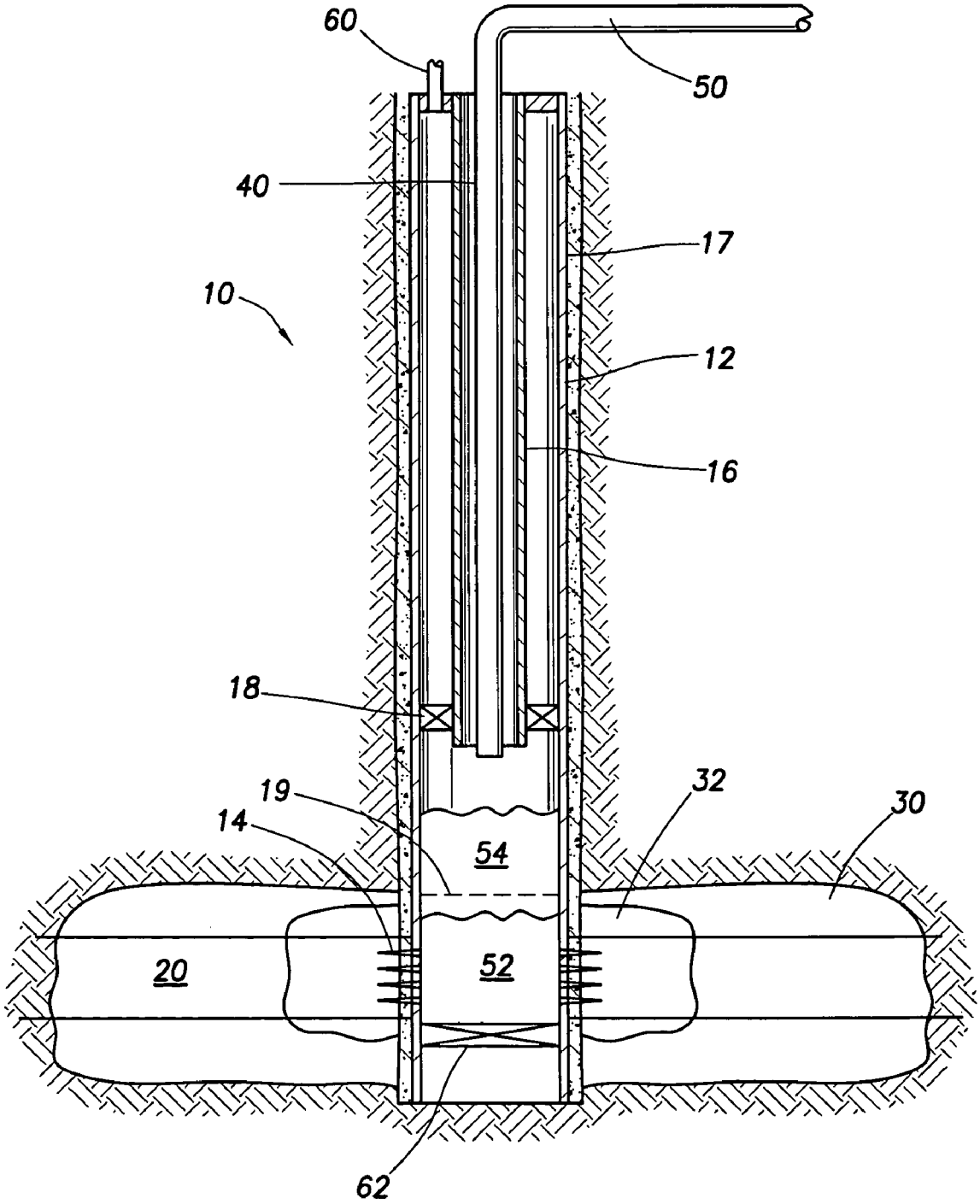
FIG. 1 illustrates a well with cemented casing that is perforated opposite a formation, with tubing and a work string in the wellbore.
Figure 2A:
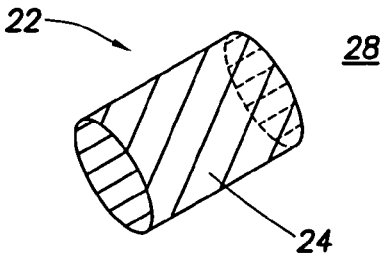
FIGS. 2(*a*)–2(*e*) illustrate volumes of cross-linked polymer solution with and without proppant and before and after coalescence of the volumes to form a polymer solution-continuous liquid phase.
Figure 2B:
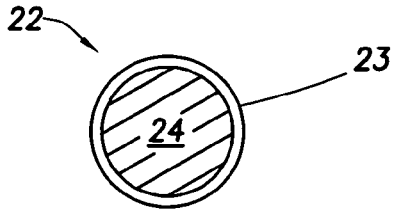
Figure 2C:
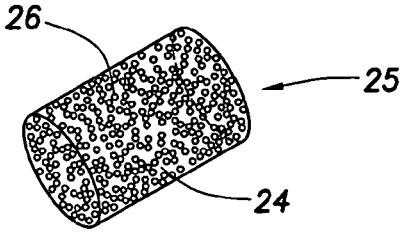
Figure 2D:
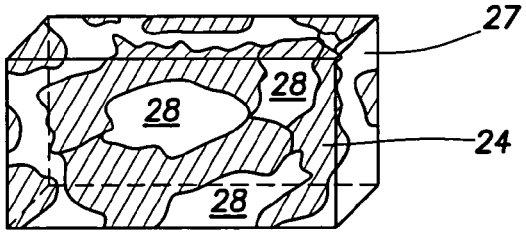
Figure 2E:
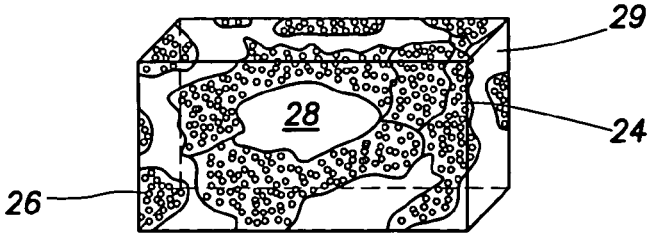

Referring to FIG. 1, wellbore 10 penetrates formation 20 where fluid is to be produced or injected. Wellbore 10 has casing 12 extending through formation 20, casing 12 being cemented in place by cement sheath 17. Perforations 14 have been formed through the wall of casing 12 and cement sheath 17 into formation 20. Perforations 14 may extend over the entire thickness of formation 20 or may extend only over a selected interval of formation 20 less than the total thickness surrounding wellbore 10. In some wells, hydraulic fracture 30 may have been formed around wellbore 10 by a previous treatment employing conventional fracturing fluid and proppant, using techniques well-known in industry. Hydraulic fracture 30 may have been formed for a time before injection of the fracturing fluid disclosed herein or may have been formed immediately before injection of the fracturing fluid disclosed herein. Alternatively, fracture 30 may not be present. Tubing 16 may have been suspended inside casing 12 and packer 18 may have been set near the bottom of tubing 16 to seal the annulus between tubing 16 and casing 12. Packer 18 may not be present in some wells, tubing 16 may not be present in some wells, and even casing 12 may not be present in some wells, although most wells in which the methods disclosed here will be applied contain casing and tubing with a packer near the bottom of the tubing. Packer 18 may have a controllable port for circulating fluids in the annulus of the well (not shown) or tubing 16 may be releasable from packer 18 to allow circulation of fluids down the tubing and up the tubing-casing annulus.

In an embodiment for damage removal near wellbore 10, the materials and methods disclosed herein may be used to form short hydraulic fracture 32 around wellbore 10 by injecting the cross-linked fracturing fluid at a pressure above the fracturing pressure of formation 20. Hydraulic fracture 32 will generally extend less than 200 feet from wellbore 10, although a fracture of greater selected lengths may be formed by proper design of fluid properties and procedures as disclosed herein. The fracturing pressure of formation 20 is generally known from fracturing pressures measured in other wells or in previous fracturing treatments down wellbore 10.

Method for hydraulic fracturing by a degradable polymer carried down a wellbore by a carrier fluid to form a fracturing fluid in the wellbore is disclosed in Ser. No. 10/253,302, filed Sep. 24, 2002, which is hereby incorporated by reference. The fracturing fluid disclosed herein may be a mixture of a cross-linked polymer solution such as that sometimes used in conventional hydraulic fracturing processes, in which a polymer solution is cross-linked in a liquid, usually water, to increase viscosity of the polymer solution, and a carrier fluid. The fracturing fluid is formed in the wellbore by coalescence of dispersed volumes of the cross-linked polymer solution in the carrier fluid to form a "polymer phase." Preferred cross-linked polymer solutions include a solution such as guar gum or guar gum derivative cross-linked with borate or a metal compound. Alternative cross-linked fluids for use in this invention include other water-soluble polymers that may be cross-linked, surfactant solutions that form gels at high concentrations, and cross-linked oil-soluble polymers, all of which are known in the art. Higher concentrations of polymer and cross-linking compounds than in prior art methods are used to form a higher viscosity fracturing fluid for the method disclosed herein.

Recent papers have described some of the cross-linked fracturing fluids used in conventional hydraulic fracturing processes. SPE 75690, "New Fluid Technology Allows Fracturing Without Internal Breakers," describes one fluid system that may be used in the method disclosed herein. A lower molecular weight guar or guar derivative is cross-linked with borate at pH above about 8.5. Base in the fluid reacts with formation rock, after the fluid in injected to form a fracture, to decrease pH of the fluid and cause viscosity to decrease to that of the un-cross-linked viscosity. In another paper describing results with this fluid, (SPE 77746, "Maximizing Well Production With Unique Low Molecular Weight Frac Fluid"), base viscosities (before cross-linking) in the range of 8 to 20 cP (centipoises) are disclosed. Such fluid is disclosed in U.S. Pat. No. 6,488,091 B1, which is incorporated by reference herein. A variety of additives, such as described in the patent, may also be employed in the methods disclosed herein. For purposes of the method disclosed herein, higher concentrations of polymer may be used to form a higher viscosity cross-linked solution, since pressure loss during flow down tubulars is controlled by another procedure and is not a significant limitation on polymer concentration as in prior art methods. Preferably, the cross-linked viscosity of the polymer solution will be about 500 cP or more at the temperature of injection into the formation. More preferably, the cross-linked viscosity of the polymer solution will be about 2000 cP or more at the temperature of injection into the formation. Most preferably, the cross-linked viscosity of the polymer solution will be about 10,000 cP or more at the temperature of injection into the formation, all measured in a Couette-type viscometer at a shear rate corresponding to the calculated shear rate during flow down a hydraulic fracture using the fluid (assumed to be 511 $sec^{-1}$). The preferred cross-linked viscosity range selected will be determined by the formation to be fractured, the amount of polymer phase to be injected, the amount of proppant to be placed, the fluid pressure in the formation to be fractured and other design parameters. The fluid viscosity should be high enough to prevent any significant settling of proppant in the wellbore or leak off of fracturing fluid from the fracture formed. Higher viscosity ranges may be used to form wider fractures if injection time is kept about the same by increasing fluid pressure at the face of the formation to be fractured. A pressure to squeeze the polymer phase fracturing fluid should be sufficient to open a fracture wide enough to accept any proppant in the fluid and less than the burst strength of any tubular in the wellbore. Of course, a suitable breaker at a concentration selected according to industry practices should be added to a cross-linked fluid.

Other presently used fracturing fluid systems can be used in the method described herein. For example, organo-borate cross linked fracturing fluids may be used, as described in the paper SPE 77747, "A Case Study of Long-Term Production Enhancement Derived from Usage of Organo-Borate Cross linked Fracturing Fluids." Other than guar and guar derivatives, polymers such as polyacrylamide cross-linked with metals may be used, surfactant or surfactant blends may be used and other materials that may be increased to high viscosity and then degraded to low enough viscosity for removal from the formation may be used. In general, the method disclosed herein allows higher viscosity fluid to be used as a fracturing fluid than in convention hydraulic fracturing, because high pumping pressure losses in the tubulars of the well are avoided.

In the conventional fracturing process, cross-linked fracturing fluid forms fracture 32 (FIG. 1) after pumping down wellbore 10. Viscosity and pumping rate of the polymer solution are limited by pressure drop in the wellbore, even though the cross-linked solution may be designed to continue to cross-link after its placement in a wellbore. The cross-linked polymer solution disclosed herein is preferably at a viscosity such that it cannot be pumped alone at practical rates through thousands of feet of well tubulars (casing, tubing or work strings). Therefore, methods are needed for placing relatively small amounts of the high-viscosity fracturing fluid in a wellbore near a selected interval of the formation where the fluid is to be injected without incurring the normal high pressure losses in the wellbore as the fracturing fluid is injected into the formation to form a hydraulic fracture. The viscosity of the fracturing fluid at conditions of injection into a fracture are preferably selected to allow a wide fracture to be formed as the fluid (or fluid containing proppant) is injected into the formation, while maintaining a rate of injection of the fluid that is compatible with mechanical limitations in the wellbore, such as maximum pressure that can be applied and the rise time of pressure at the perforations that can be achieved by pumping at the surface or otherwise applying pressure to the fluid above and in contact with the fracturing fluid. Preferably, the cross-linked fracturing fluid placed at the perforations should allow very low fluid loss, in any, through the perforations before application of squeeze pressure.

In one embodiment, the high-viscosity cross-linked fluid of this invention is placed in the wellbore in the form of discrete volumes of fluid and transported through tubulars in the wellbore while dispersed in a low-viscosity carrying fluid. In another embodiment, the cross-linked fluid is extruded into the carrying fluid at a concentration such that it flows on a film of carrying fluid or flows by lubricated flow down the wellbore. A preferred relative volume of carrier fluid to cross-linked fluid required can be readily determined by injecting the fluids at a range of volume ratios. The cross-linked polymer solution is then accumulated in the wellbore at a selected location, preferably in the casing near and above the perforations in the casing, so that the cross-linked solution becomes a continuous or external phase. This is achieved by insuring that the cross-linked fluid, which may contain proppant, is of higher specific gravity than the carrier fluid. Soluble salts may be added to the cross-linked fluid to increase density. Some amount of carrying fluid will then become dispersed (i.e., become the discontinuous phase) in the cross-linked polymer solution. The carrying fluid is preferably brine or oil. The fractional volume of cross-linked degradable polymer in the carrying fluid-polymer mixture when it is being pumped down the well should be in the range such that polymer is not the continuous phase or such that lubricated flow of the polymer occurs in the tubing until the polymer is near the depth it is to be injected. Surfactants and polymers soluble in the carrying fluid may be added to the carrying fluid to decrease viscous losses during placement of the volumes of cross-linked polymer solution in the well. When cross-linked polymer solution becomes the continuous or external phase, the fraction of polymer solution will have increased to greater than about 50 per cent by volume. Higher cross-linked polymer solution fractions are preferred because proppant concentration in the fracturing fluid and the fracture will be increased. A slurry of dispersed volumes of cross-linked polymer solution in placement fluid may be pumped to the perforations, at which time flow rate will drop to zero or near zero because of the very high viscosity of the cross-linked polymer solution and following polymer solution in the tubulars may be allowed to settle by gravity and accumulate in the wellbore. In another embodiment, cross-linked polymer particles are accumulated or concentrated in the wellbore by centrifugal or other solid-liquid separation methods near the depth where the polymer is to be injected. It should be noted that in this embodiment of the method the cross-linked polymer solution phase is pumped down the wellbore at a rate and pressure below the rate and pressure required to form a hydraulic fracture in the formation.

FIG. 2 illustrates configurations of cross-linked polymer solution and proppant that may be used as materials in the disclosed process and their changes in configuration in the wellbore. In FIG. 2(*a*), a discrete volume of cross-linked polymer solution 22 is illustrated. Such volumes may be cylinders, as shown, spheres, or irregular shapes. Cylinders may be formed by an extrusion and chopping process, for example. The dimensions of cylinders may be, for example, from about 1/16 inch to about 1-inch diameter and length. A distribution of sizes may be used to form a mixture of discrete volumes that allows closer packing when the fluid volumes settle by gravity or are filtered against a barrier in the wellbore. The discrete volume may be dispersed in carrier fluid 28 to form a dispersion in which the discrete polymer volumes are the internal phase. Additives to increase the specific gravity of the discrete cross-linked polymer volumes may be added in the form of particles of mineral, preferably a water-soluble mineral, or dust-size particles if they are not soluble, or soluble salts. Referring to FIG. 2(*b*), coating 23 of encapsulating material designed to decrease stickiness of the dispersed cross-linked polymer solution may be added, as shown in a cross-section of particle 22. Such encapsulating materials, such as high molecular weight polymers and colloidal silica, are well known. In FIG. 2(*c*), discrete volume 25 containing proppant 26 dispersed in cross-linked polymer solution 24 is illustrated. Proppants such as silica sand, often used in hydraulic fracturing of wells, may be used. A preferred proppant is a ceramic material such as ECONOPROP, CARBOPROP or CARBO HSP, available from CarboCeramics, Inc. of Irving, Tex. Preferably, smooth and nearly round ceramic proppant particles, made by processes known in the industry, are used. In FIG. 2(*d*) element 27 of polymer-phase fracturing fluid, formed when cross-linked polymer solution 24 in particles 22 becomes the continuous phase and encloses carrier fluid 28, is illustrated. Finally, FIG. 2(*e*) illustrates element 29 of proppant-laden polymer-continuous liquid phase fracturing fluid, formed when cross-linked polymer solution 24 in pellets 25 becomes the continuous or external phase and can carry proppant 26 along with dispersed carrier fluid 28 into a fracture.

When the polymer degrades or becomes no longer cross-linked such that viscosity is greatly decreased, fluid flow can then occur through the proppant, if any, carried into a hydraulic fracture. When the term "degrades" or similar terms are used herein, it should be understood that some amount of non-soluble compounds might be present to form a residue after a fraction of the polymer has degraded or the polymer solution may still have a viscosity greater than the viscosity of water. The residue may be caused by impurities in the polymer, for example, or large macromolecules left after the degradation reactions. The residue may decrease flow capacity through the proppant after polymer degradation, and therefore should be maintained at low values, preferably less than about 20 per cent of polymer volume and more preferably less than about 5 per cent.

Several processes may be employed to form discrete volumes of cross-linked polymer and to place the discrete volumes in a wellbore while dispersed in a carrying fluid. In one embodiment for forming discrete volumes of cross-linked polymer, a bulk volume of cross-linked polymer is formed and then mechanically cut or sheared into discrete volumes of polymer than can be placed in a stream of carrier fluid that can flow down a wellbore without passing through a pump. The bulk volume of cross-linked polymer may be formed using well known techniques suitable for the particular polymer employed. In general, dry polymer is hydrated or solvated and one or more chemical compounds are added to cross-link the polymer. For example, guar and its derivatives may be cross-linked by adding a borate compound and a base to adjust pH to about 8.5 or more. Compounds used to cross-link the polymer may be added to the carrier fluid to avoid diffusion loss of the compound from the discrete volumes of cross-linked polymer while in the wellbore. Information for cross-linking a variety of polymers and surfactants is readily available in industry. Preferably, concentrations of polymer and cross-linking compounds are adjusted to increase viscosity and gel strength to give the discrete volumes of cross-linked polymer mechanical strength sufficient for handling and transport down a wellbore while maintaining their integrity as a discrete volume.

In one embodiment for placing the volumes of cross-linked polymer in a wellbore, carrying fluid and the discrete volumes are pumped into a wellbore while displacing the fluid initially present in the wellbore into the formation. When the cross-linked polymer volumes reach the perforations and pumping pressure increases, pumping is stopped or slowed and time is allowed for additional volumes of cross-linked polymer to accumulate by settling near and above perforations. The polymer phase is later extruded through the perforations as squeeze pressure is applied in the wellbore. In another embodiment, the discrete volumes of cross-linked polymer may be placed in the well and allowed to fall from the surface to the bottom of the well. In another embodiment, the cross-linked polymer is placed in a wellbore using a dump bailer. Other methods for placing the cross-linked polymer fracturing fluid near the zone to be fractured are suitable. A displacement fluid, which should have lower density than the polymer phase, is then used to displace the polymer phase, which may contain the carrier fluid as a discontinuous fluid, through the perforations. The cross-linked polymer fluid may be selected to exhibit syneresis after accumulating in the casing and before displacement into the formation. The liquid film between the polymer phase and the wall of the casing, formed during syneresis, may decrease viscous pressure drop of the polymer phase in the wellbore as it is expelled from the casing into the formation.

Alternatively, screen 19 (FIG. 1) may be placed in wellbore 10 above perforations 14 and discrete volume of the cross-linked polymer may be accumulated above screen 19. When carrying fluid is injected, the screen allows determination of whether cross-linked polymer is still dispersed in the carrying fluid or whether the particles have coalesced to form a continuous polymer phase. Screen 19 may then be opened or released by known methods, such as by shearing a pin, so as to allow polymer phase fracturing fluid, such as shown in FIG. 2(*d*) or 2(*e*), to reach perforations 14. A coating may be deposited from a carrier fluid on to tubing 16 and casing 12 (FIG. 1) where they may be contacted by cross-linked polymer. Such coating may be used to decrease sticking of the cross-linked polymer to the walls of the tubing or casing or to increase slip flow of the cross-linked polymer. Such coating may be a polymer or polymer-wax mixture or other material such as used in encapsulation processes.

Ball sealers may be added to the carrying fluid or to the cross-linked polymer in any injection method discussed herein. The ball sealers should preferably be designed to remain rigid during the pumping time of the fracturing fluid into a formation. They allow diversion of the flow of the fracturing fluid from one perforation to other perforations when seating of a ball sealer occurs on a perforation. The ball sealers may be conventional rubber-covered balls or degradable ball sealers such as disclosed in U.S. Pat. No. 4,716,964 or any other ball sealers.

Figure 3A:
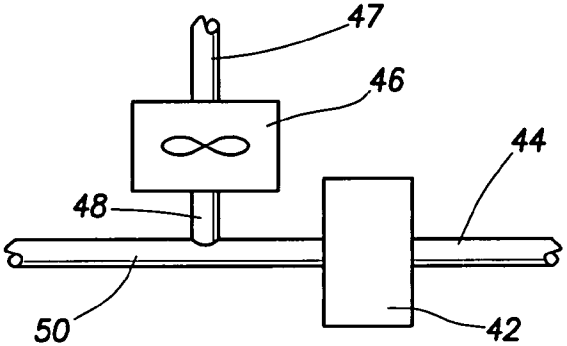
FIGS. 3(*a*) and (*b*) illustrate schemes for injecting volumes of a viscous fluid such as cross-linked polymer solution into a wellbore.
Figure 3B:
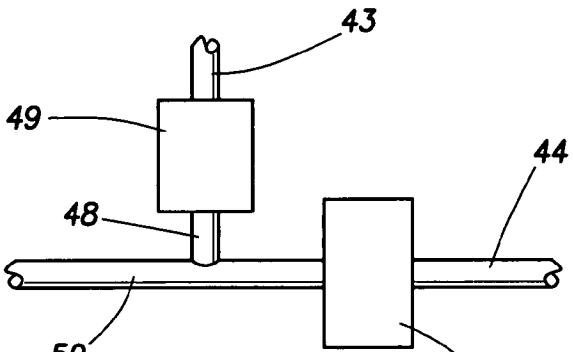

Another method for injecting the discrete volumes of cross-linked polymer, with or without proppant dispersed in the cross-linked polymer, is shown in FIG. 1 and FIG. 3(*a*). Work-string 40 (FIG. 1) has been placed in the well through tubing 16. Work-string 40 may be coiled tubing. A pressure seal will be placed between workstring 40 and tubing 16 with a return flow line and choke (not shown) for return fluid. Work-string 40 is connected to fluid supply line 50.

Referring to FIG. 3(*a*), in one embodiment pump 42 takes suction of carrier fluid through pipe 44. A slurry of carrier fluid and discrete volumes of cross-linked polymer is formed in pressurized vessel 46, which may be stirred. Pressure line 47 may be used to drive the slurry from vessel 46 through line 48. The slurry is mixed with the fluid discharged from pump 42 in fluid supply line 50. Diluted slurry may be then pumped downhole through work string 40 as return fluid 60 flows back to surface. (FIG. 1) Alternatively, the slurry may be pressured downhole directly from stirred tank 46 without dilution and without use of pump 42. In another embodiment, the slurry of cross-linked polymer and carrier fluid may be pumped by slurry pump 49, as illustrated in FIG. 3(*b*). Pump 49 takes suction through slurry line 43 and discharges through high-pressure slurry line 48 into fluid supply line 50. The discrete volumes of cross-linked polymer placed in the well may contain increasing amounts of proppant as additional discrete volumes of cross-linked polymer are pumped. For example, a selected amount of discrete volumes of cross-linked polymer that contains no proppant may be pumped first. Plug 62 is preferably placed just below perforations 14 (FIG. 1) before pumping of polymer into the well commences, so that discrete volumes of cross-linked polymer will accumulate in the casing over and above the perforations and not below the perforations. Alternatively, sand or other material may be placed in the wellbore below the perforations. Then low concentrations of proppant in the discrete volumes of cross-linked polymer may be added and the concentration of proppant increased as additional polymer is injected into the well. The size of proppant may also be changed as additional polymer is placed in the well. This requires that discrete volumes of cross-linked polymer be available with differing concentrations and sizes of proppant. Ball sealers may be added to the carrier fluid as the fluid is pumped downhole, using well known industry methods for ball sealer injection. Ball sealers may also be added to portions of the cross-linked polymer. Squeeze pressure to inject the fracturing fluid from the wellbore into the formation may be applied through tubing or work string. A packer on the work string either in or below the tubing may be set to isolate squeeze pressure to that portion of the wellbore below the packer. Without tubing in the well, a packer on a work string would be set to isolate pressure below the packer and prevent squeeze pressure on the casing string.

In another embodiment (see FIG. 1), work string 40 is not placed in well 10 and tubing 16 is released from packer 18 or a bypass valve (such as a sliding sleeve in tubing 16) is opened and a slurry or a mixture of the slurry and carrying fluid is circulated down tubing 16. In yet another embodiment, the slurry or a mixture of slurry 48 and a pumped fluid is "bullheaded" down tubing 16. The slurry may be pumped or pressured all the way to the perforations or may be displaced to any selected depth in the well from which the discrete volumes of cross-linked polymer may settle by gravity to a location adjacent perforations 14 or on screen 19. The slurry may be displaced with a displacement fluid. Again, discrete volumes of cross-linked polymer having higher concentrations of proppant may be pumped as more polymer fracturing fluid is placed in the well. Water or brine may be used as a carrier fluid. Alternatively, a hydrocarbon liquid such as diesel oil may be placed in the well or used as a carrier fluid. Also, hydrocarbon may be used to obtain a higher density difference between discrete volumes of cross-linked polymer and wellbore fluid. If the density of the discrete volumes of cross-linked polymer is less than wellbore fluid density, then discrete volumes of cross-linked polymer may be pumped to the formation where they are to be injected and increased fluid pressure be used to force the discrete volumes of cross-linked polymer into the formation before they rise through the wellbore.

Cross-linked polymer that contains no proppant particles, such as shown in FIG. 2(*a*), may be placed in the well first. In this instance, after the polymer has become the continuous phase of the polymer phase, such as shown in FIG. 2(*d*), it may be forced or squeezed into the formation at fracturing pressures to form a fracture that will not be propped. Such a fracture can increase production rate from some wells after the polymer degrades by removing near wellbore damage, which may include moving solids that are plugging perforations farther from the wellbore or perforations. Also, the hydraulic fracture formed in the formation may not completely close after it is formed, allowing greater flow rate into the well after the fracturing fluid has degraded.

Cross-linked polymer containing proppant particles, such as shown in FIG. 2(*c*), may be injected just as described above for polymer without proppant. After the polymer has become the continuous phase of the polymer phase, such as shown in FIG. 2(*e*), it will be necessary that the pressure applied to the wellbore to squeeze polymer through the perforations be adequate to open a fracture wider than the diameter of the proppant particles. The pressure required will depend on the properties of the rock, the viscosity of the cross-linked polymer and the diameter of the proppant particles. If the rock is soft enough (low modulus), the effective polymer-phase viscosity is high enough and the proppant diameter is small enough, proppant-laden cross-linked polymer may be injected to form a hydraulic fracture without the necessity of first injecting a "pad" of cross-linked polymer. For the polymer phase to have high effective viscosity in a fracture, lubricated or slip velocity of the polymer phase at the wall of the fracture must be controlled. This may require that cross-linked polymer be the continuous phase of the fracturing fluid and that excess carrier fluid not be present. In some fracturing conditions, slip flow in the fracture may be desirable and in other fracturing conditions materials and method are needed to prevent slip flow in a hydraulic fracture. Without lubricated or slip flow, a highly viscous fracturing fluid can be used to form a short fracture, but a fracture that is long enough to extend beyond a damage zone around a well, with a relatively small amount of fracturing fluid.

Alternatively, cross-linked polymer without proppant dispersed therein may be first injected as a pad fluid to form a hydraulic fracture. Polymer containing proppant may then be injected. The proppant-free polymer will be placed in the wellbore first. Layers of polymer containing increasing sizes or concentrations of proppant may also be successively placed in the wellbore. Alternatively, proppant-containing polymer may be placed in the wellbore after proppant-free polymer has already been injected into the formation and before the proppant-free polymer has degraded enough to allow leak-off of the cross-linked polymer solution into the formation. Measurements of viscosity of the cross-linked polymer during degradation versus time under conditions in a reservoir fracture may be used to determine the time available to place more polymer in the wellbore for injecting into the formation before the previously formed fracture has closed. A displacement fluid used to squeeze or displace the fracturing fluid from the wellbore into the formation should have lower density than the polymer phase fracturing fluid. This density difference prevents or minimizes "fingering" of displacement fluid through the polymer phase in the wellbore.

Figure 4A:
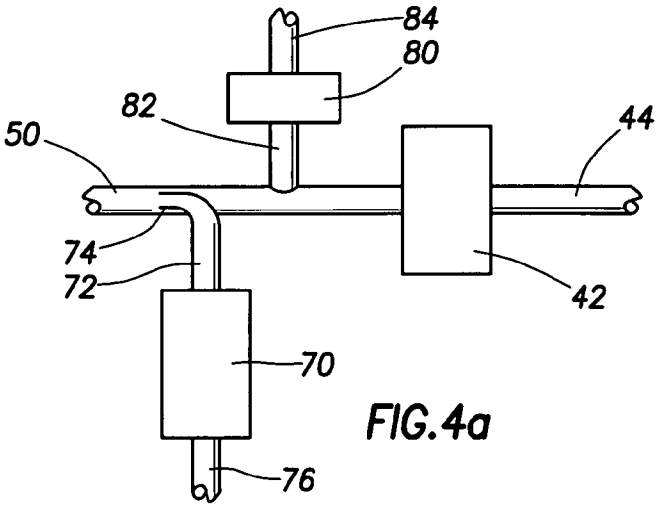
FIGS. 4(*a*) and (*b*) illustrate schemes for extruding a continuous phase of a viscous fluid such as a cross-linked polymer solution into a stream entering a wellbore.
Figure 4B:
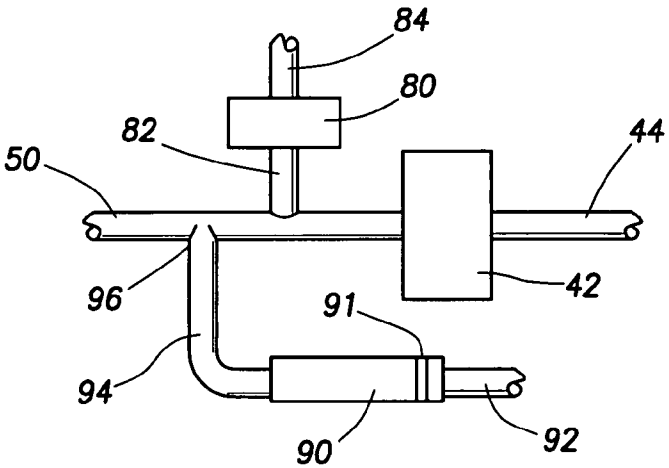

An alternative procedure and surface equipment for placing degradable polymer in a wellbore and moving it downhole to a location near an interval where it is to be injected into the formation to be fractured is shown is FIG. 4(*a*). Here pump 42 brings carrier fluid into fluid line 50 as described before and cross-linked polymer is injected or extruded into line 50 by pump 70, which has feed line 76. Line 72 conveys polymer to orifice 74, which feeds polymer into the flow in pipe 50. Orifice 74 may have a diameter almost as great as line 50 or it may be much smaller, depending on the quantities and size of discrete volumes of cross-linked polymer to be used to form a polymer phase to be injected into a formation. Line 50 may have the same inside diameter as the tubing in the well. Pump 70 may be of the type ordinarily used in injection molding or extrusion of thermoplastic polymers. The cross-linked polymer may be heated before pumping. Such progressing cavity pumps are available from Blackmer Flow Technologies, Inc. of Calgary, Alberta, Canada, for example. In another embodiment, illustrated in FIG. 4(*b*), cross-linked polymer in cylinder 90 is pressured through line 94 and orifice 96 into flow line 50. Pressure is supplied to cylinder 90 behind piston 91 through line 92. In the embodiment illustrated in FIG. 4(*a*) or 4(*b*), flow rate of polymer may be adjusted such that polymer phase is not the continuous phase in the tubing or such that wall slip prevents high friction loss in tubulars as the polymer is placed near the interval in the wellbore where it will be injected into the surrounding formation. The cross-linked polymer may be brought to a well site or formed on site. Also, in either embodiment, chemicals may be injected in flow line 50 by chemical pump 80, fed by line 84, and discharged through line 82. Chemicals to prevent polymer sticking to the wall of tubulars or to other polymer surfaces, such as colloidal silica, or other encapsulating chemicals may be injected at this point. In one embodiment, excess water that is used to pump cross-linked polymer to near the depth where it is to be injected into a formation is removed by allowing the excess water, which will be in an external water phase, to flow into the annulus through a filter section near the bottom of the tubing (not shown). Using this procedure, the polymer phase will have higher effective viscosity in a hydraulic fracture.

Figure 5:
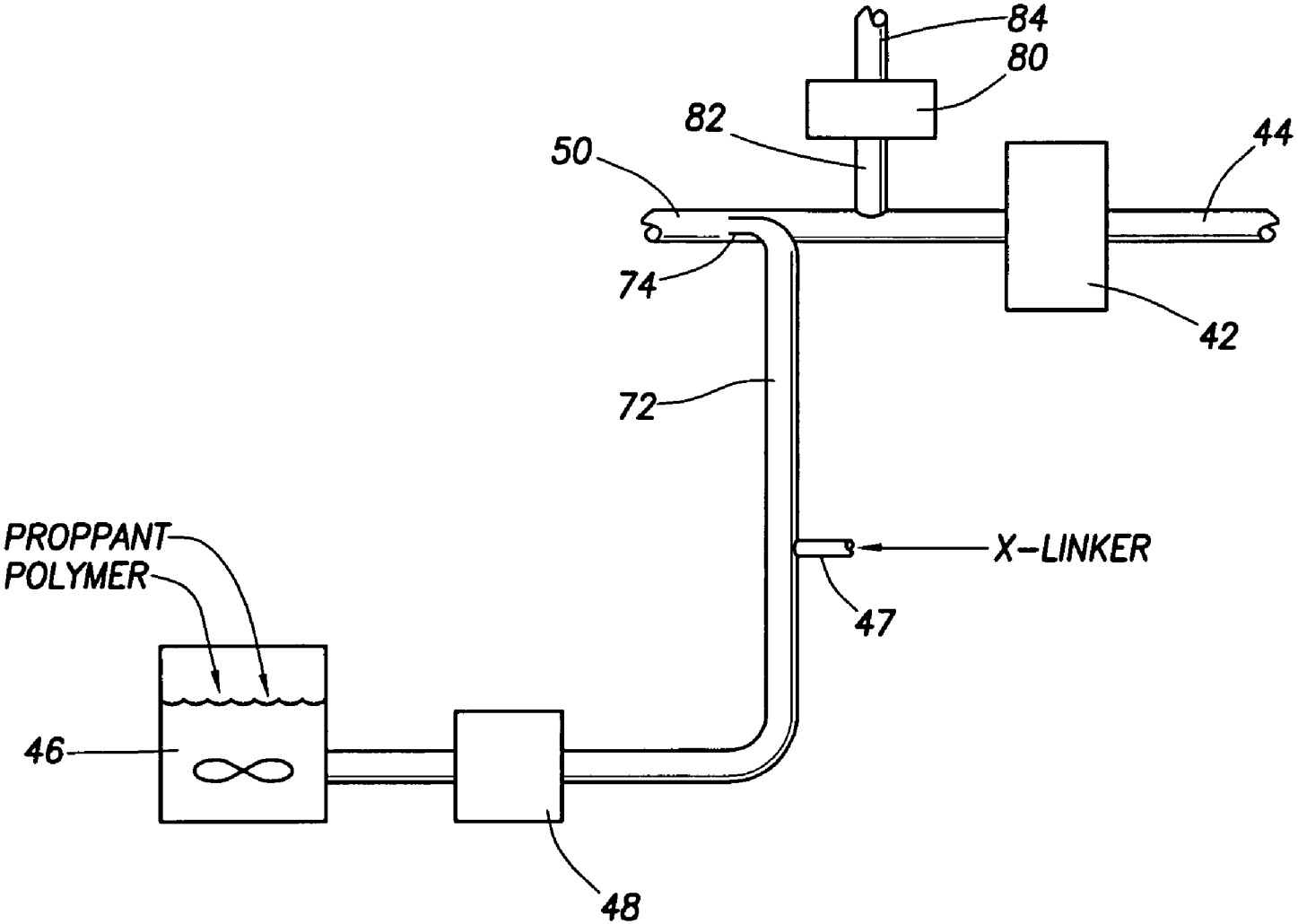
FIG. 5 illustrates apparatus for forming a cross-linked polymer solution and injecting it into a stream.

In another embodiment, cross-linked polymer is formed on-site and supplied to apparatus such as described above. FIG. 5 illustrates apparatus for forming cross-linked polymer and injecting it into a flowline. Pump 42 brings carrier fluid into fluid line 50 as described before. Base polymer solution is formed in blender tub 46, where polymer is mixed with base fluid, normally brine. Mixing procedures for base fluid are well known in industry. Proppant may be added to hydrated base fluid in blender tub 46. Pump 48 increases the pressure of base fluid to injection pressure and cross-linking chemical is added through line 47. A mixing section may be included to insure uniform mixing of cross-linking chemical. Cross-linked polymer is then injected or extruded into line 50 through feed line 72 and nozzle 74. Orifice 74 may have a diameter almost as great as line 50 or it may be much smaller, depending on the quantities and size of discrete volumes of cross-linked polymer to be used to form a polymer phase to be injected into a formation. Line 50 may have the same inside diameter as the tubing in the well. Other chemicals may also be added to the flow in line 50 through line 82, as described above.

The methods of polymer injection illustrated in FIGS. 4(*a*) and 4(*b*) and FIG. 5 may be particularly appropriate for injecting cross-linked polymer at the end of conventional fracturing treatments, where accumulation of polymer in the wellbore before injection into the formation may not be necessary, but may also be used to inject degradable polymer into a wellbore for any application, including those in which polymer is accumulated in the wellbore. Most of the injection methods described above include accumulation of polymer in the wellbore so as to minimize or eliminate slip flow of polymer in the fracture. These applications include use in a well to form a short initial fracture, to place proppant in an existing fracture or replace damaged proppant in an existing fracture. Preferably, some of the polymer phase contains proppant, but benefits in some wells may be realized without proppant in the polymer phase.

In other embodiments, the cross-linked polymer phase may be injected, using methods illustrated in FIGS. 3, 4 and 5, for example, immediately after the fluids used in a conventional fracturing treatment have been pumped into a wellbore and before the "flush" of the conventional fluid and proppant to the perforations. The cross-linked polymer disclosed herein will normally be more rigid or viscous than the conventional cross-linked fracturing fluid. The higher viscosity or gel strength will normally be achieved by increasing the concentration of base polymer or of cross-linking compounds or both. The amount of increased polymer concentration will depend of the polymer used. The presence of the cross-linked polymer phase, preferably containing proppant, in the perforations and in the fracture near the wellbore can have at least two beneficial effects: (1) it can prevent flowback of proppant into the wellbore if a zero or positive pressure from the wellbore into the fracture is maintained long enough for the fracture to close. The fracture will close or almost close with polymer near the wellbore preventing movement of fluid between perforations and in the fracture near the wellbore. By the time the cross-linked polymer has become flowable, the walls of the fracture will prevent movement of proppant out of the fracture. Degradation time of the polymer should be selected to be long enough such that the zero or positive pressure into the formation can be maintained until the fracture closes. (2) The cross-linked polymer phase can prevent "overflushing" of proppant away from the wellbore, leaving unpropped fracture very near the wellbore. Proppant in the cross-linked polymer, which will be kept near the wellbore by high viscosity of the polymer phase, will remain in the fracture all the way to the wellbore and will prevent closing of the fracture at that location. Then the long fracture created and propped by conventional materials can conduct fluids into the well with greater efficiency.

After cross-linked polymer is placed in a well and before it is squeezed into the formation, the polymer, at least some of which usually containing proppant particles, will normally occupy from several feet to hundreds of feet near and above the perforations in the casing. For example, if a fracture is to be formed having a height of 50 feet, a length of 10 feet in each of two directions from the well and a width of 0.05 foot, the volume of continuous phase cross-linked polymer required will be 50 $ft^3$. Common production casing sizes have a cross-section area in the range of 0.25 $ft^2$. Therefore, about 200 ft of polymer phase, after settling or compacting in casing, will be adequate to form the fracture. The polymer phase may also extend into the tubing. After placement in the wellbore and possibly allowing time for the cross-linked polymer to reach a preferable viscosity range, if it is too rigid when placed in the wellbore, the polymer phase is pressured or squeezed into the formation around the well. A time after polymer placement and before pressuring into the formation may be allowed for the polymer to increase in temperature and become less rigid or viscous. For example, the polymer may decrease in rigidity or viscosity and may deform, with polymer enclosing the carrying fluid used to place the cross-linked polymer in the well to form the polymer-continuous phase.

FIG. 1 shows interval 52 of casing 12 that is filled with cross-linked polymer phase without proppant. (Screen 19 will not be present in the well in this example. When screen 19 is present, the bottom of interval 52 will be at the screen.) Higher in the casing, to be injected after the polymer in interval 52, is interval 54 of cross-linked polymer having proppant dispersed therein. Additional intervals of casing 12 or tubing 16 may be filled with degradable polymer containing increasing concentrations or increasing size, or both, of proppant.

Preferably, after the cross-linked polymer has become continuous in the polymer phase, a surface pressure is applied to the wellbore at the surface, normally through tubing 16 or workstring 40, to pressure or squeeze the polymer phase containing degradable polymer, which may contain proppant, through perforations 14 and into formation 20. The pressuring fluid will normally be the same as the carrying fluid. The carrier fluid should have lower specific gravity than the polymer phase.

After proppant-laden polymer in a polymer phase has been squeezed through the perforations, the polymer is allowed to degrade before the well is placed in use (i.e., placed on production or injection). Degradation time can be estimated from laboratory experiments in which the cross-linked polymer is placed in brine at the temperature estimated for temperature in the wellbore and in the fracture in the formation being treated. After sufficient degradation time of the polymer, the well can be produced or fluid can be injected at higher flow rates than before the fracturing treatment. This result may be achieved because the fracture extends through a damaged zone near the wellbore or the new proppant bed in the fracture connects a pre-existing fracture to the wellbore with higher flow capacity, or overflushing or backflow of proppant after a conventional fracturing treatment has been avoided.

If a well is to be gravel packed in a particular formation or zone, a fracture can be formed in that zone using the methods and materials disclosed herein and the degradation time of the cross-linked polymer can be selected to allow placement of a screen or other equipment in the well, if needed, and gravel packing outside the screen while the fracture is still plugged with degradable polymer. A fracture treatment in the first zone may be performed down the casing, using appropriate placement techniques such as described above. For example, the cross-linked polymer may be placed in casing over a bridge plug set at the bottom of perforations into the zone to be fractured. A packer set above the cross-linked polymer in the casing and the bridge plug on a work string can be used to squeeze the cross-linked polymer through the perforations. Other operations in the wellbore can be performed while the fracture in the first zone is still plugged with cross-linked polymer. Several zones may be fractured and operations may be performed in the wellbore, such as placement of a screen for gravel packing all the fractured zones and placement of the gravel, before the cross-linked polymer in the fractures has degraded. Recompletions, stimulation processes or any other wellbore process can be carried out in other zones without damaging the previously fractured zone or losing fluid from the wellbore into that zone during the time the cross-linked polymer has not degraded.

While particular preferred embodiments of the present invention have been described, it is not intended that these details should be regarded as limitations upon the present invention, except as and to the extent they are included in the following claims.

What I claim is:

1. A method for hydraulic fracturing of a formation around a wellbore, the wellbore having a volume, comprising:

(a) placing a volume of cross-linked fracturing fluid in the wellbore, the volume of the cross-linked fracturing fluid being less than the volume of the wellbore;

(b) displacing the cross-linked fracturing fluid down to a perforation in the casing by a displacement fluid; and (c) applying pressure to the displacement fluid by pumping so as to inject the cross-linked fracturing fluid through the perforation into the formation to form a hydraulic fracture.

2. The method of claim 1 wherein the cross-linked fracturing fluid has a viscosity greater than about 500 cP at a temperature of injection into the formation.

3. The method of claim 1 wherein the cross-linked fracturing fluid has a viscosity greater than about 2,000 cP at a temperature of injection into the formation.

4. The method of claim 1 wherein the cross-linked fracturing fluid has a viscosity greater than about 10,000 cP at a temperature of injection into the formation.

5. The method of claim 1 wherein step (a) is performed by placing the cross-linked fracturing fluid in the wellbore in the form of discrete volumes of fluid in a carrier fluid.

6. The method of claim 1 wherein step (a) is performed by placing the cross-linked fracturing fluid into a stream having a carrier fluid at a concentration such that the cross-linked fracturing fluid flows on a film of carrier fluid.

7. The method of claim 6 wherein a surfactant or polymer is added to the carrier fluid to promote wall slip during flow of the cross-linked fracturing fluid.

8. The method of claim 1 wherein step (a) is performed by placing the cross-linked fracturing fluid in the wellbore and allowing the fluid to fall by gravity down the wellbore.

9. The method of claim 1 wherein at least a portion of the cross-linked fracturing fluid contains a proppant.

10. The method of claim 1 further comprising the step after step (b) of allowing a time for the cross-linked fluid to decrease in viscosity.

11. The method of claim 1 further comprising the steps of forming a hydraulic fracture in the formation around the wellbore and then performing steps (a) and (b) and injecting the cross-linked fracturing fluid into the hydraulic fracture before closure of the hydraulic fracture.

12. The method of claim 1 further comprising the step of forming a hydraulic fracture in the formation around the wellbore and then performing steps (a) and (b) and injecting the cross-linked fracturing fluid into the hydraulic fracture after closure of the hydraulic fracture.

13. The method of claim 1 further comprising the step of performing another operation in the wellbore after step (c) and before a time for the cross-linked fracturing fluid to degrade.

14. The method of claim 13 wherein the other operation in the wellbore is gravel packing.

15. The method of claim 1 further comprising the step of transporting ball sealers down the wellbore along with or following the cross-linked fracturing fluid.

16. The method of claim 1 wherein the cross-linked fracturing fluid comprises a water-soluble polymer.

17. The method of claim 1 wherein the cross-linked fracturing fluid is selected to exhibit syneresis.

18. The method of claim 1 wherein the cross-linking of the cross-linked fracturing fluid is delayed after a cross-linking material is added to the fluid.

19. The method of claim 1 wherein a surfactant or polymer is added to the cross-linked fracturing fluid to promote wall slip during flow of the cross-linked fracturing fluid.

20. The method of claim 1 wherein the cross-linked fracturing fluid is displaced from the wellbore by a fluid having a lower specific gravity than the specific gravity of the cross-linked fracturing fluid.

21. The method of claim 1 wherein the cross-linked fracturing fluid occupies about 200 feet or less in the casing above the perforation.

22. The method of claim 1 wherein the volume of the cross-linked fracturing fluid is less than about 50 $ft^3$.

23. The method of claim 1 wherein the volume of the cross-linked fracturing fluid is less than about 250 $ft^3$.

* * * * *